US005425595A

United States Patent [19]

Roper

[11] Patent Number: 5,425,595

[45] Date of Patent: Jun. 20, 1995

[54] POP-UP TRAFFIC CONTROL DEVICE

[76] Inventor: David H. Roper, 1732 Hill St., Santa Monica, Calif. 90405

[21] Appl. No.: 975,933

[22] PCT Filed: Aug. 6, 1990

[86] PCT No.: PCT/US90/04352

§ 371 Date: Feb. 19, 1993

§ 102(e) Date: Aug. 16, 1993

[87] PCT Pub. No.: WO92/02683

PCT Pub. Date: Feb. 20, 1992

[51] Int. Cl.[6] ..... E01F 9/011

[52] U.S. Cl. ..... 404/9; 49/49; 49/131

[58] Field of Search ..... 404/6, 9, 10, 11, 13, 404/12, 14; 49/49, 35, 131; 40/608, 612

[56] References Cited

U.S. PATENT DOCUMENTS

| | | | |
|---|---|---|---|
| 2,610,502 | 9/1952 | Carlson | 72/7.3 |
| 3,086,430 | 4/1963 | Emmel | 404/6 |
| 3,660,935 | 5/1972 | Boots | 49/35 |
| 3,698,135 | 10/1972 | Boots et al. | 49/35 |
| 3,963,363 | 6/1976 | Roper | 404/11 |
| 4,203,686 | 5/1980 | Bowman | 49/35 X |
| 4,576,508 | 3/1986 | Dickinson | 404/6 |
| 4,666,331 | 5/1987 | Riley | 404/6 |
| 4,713,910 | 12/1987 | Quante | 49/131 X |
| 4,715,742 | 12/1987 | Dickinson | 404/6 |
| 4,919,563 | 4/1990 | Stice | 404/6 |

FOREIGN PATENT DOCUMENTS

| | | | |
|---|---|---|---|
| 772855 | 12/1967 | Canada . | |
| 1324324 | 7/1973 | United Kingdom | 404/10 |
| 1563293 | 3/1980 | United Kingdom | 404/10 |
| 2107446 | 4/1983 | United Kingdom . | |

*Primary Examiner*—Ramon S. Britts
*Assistant Examiner*—James A. Lisehora
*Attorney, Agent, or Firm*—Cislo & Thomas

[57] ABSTRACT

A pop-up traffic control device (10) is raised above or withdrawn below the pavement surface through a bore in the cover (18). A lead screw (16), rotated by power source (30), raises a traffic marker tube (12) by a follower tube socket (14) attached to the lead screw (16). The follower tube socket (14) moves vertically on the lead screw (16) and is rotated to either raise or retract the traffic marker tube (12) above or below the roadway. The interior of the traffic control device is sealed from external foreign matter by a linear tube (48) in the cover bore surrounding the traffic marker tube (12). The traffic marker tube (12) is easily replaceable. Additional features include: a slope adjustment mechanism, a heating unit (74), a lead screw lubrication/cleaning arrangement (80, 82), lighting units (84) for the traffic marker tube (12), a watertight coupling (90, 92), a variable-speed arrangement for the lead screw rotation, and a marker tube status signal unit.

26 Claims, 2 Drawing Sheets

POP-UP TRAFFIC CONTROL DEVICE

BACKGROUND OF THE INVENTION

The control of vehicular traffic often requires that certain lanes be closed to traffic and that traffic be redirected to other lanes temporarily during peak traffic hours or as a result of repair work being done. Control can be accomplished by setting warning and redirection markers by hand in the roadway but this method suffers from the disadvantages of requiring a substantial implementation time and posing hazards to the personnel placing the markers.

An automatic system of raising traffic control devices up from storage positions beneath the pavement in response to remote control signals is much more desirable. Pneumatic devices, such as those disclosed in U.S. Pat. Nos. 3,530,775 and 3,447,429, have been used but require close clearance tolerances within their construction to prevent excessive air leakage and are also subject to problems of contamination by dirt, sand, ice, snow, oil, and other materials often found on the roadway. The installation of pneumatic lines in the road is also costly and time consuming.

An improved traffic control device operated mechanically by remote control was disclosed in U.S. Pat. No. 3,963,363 to Roper, which is hereby incorporated by reference herein. The control device is attached to a follower which is engaged in the thread of a screw member caused to rotate by a remote signal, thus affecting the elevation of the control member above its storage position flush with the ground.

It would be a great advance in traffic control technology if a pop-up traffic control device similar to the one disclosed in the patent to Roper could be provided with the following features: (1) a system of sealing the device so that the interior of the storage chamber is not contaminated by foreign matter from the outside; (2) a removable tube connector system so that the traffic marker can be changed easily; (3) a modular collar with integral electrical connector; (4) a unit for signalling the up-or-down status of the device; (5) a heating unit component; (6) a slope adjustment device; (7) a lubrication and brush device; (8) a lighting unit; (9) a watertight assembly; and (10) a variable-speed feature.

SUMMARY OF THE INVENTION

The invention disclosed herein overcomes the disadvantages of the prior art and possesses all of the advantages listed above by providing a simple mechanical device which can be actuated by a variety of power sources. A coarse lead screw is rotated by a power source to raise a traffic marker tube by means of a follower tube socket to which the traffic marker tube is attached. The follower tube socket is constrained from rotating and advances along the screw as the screw is rotated to raise the traffic marker into its proper place in the roadway. The traffic marker is retracted by reversing the direction of the power source and the direction of rotation of the screw.

A notched flange on the outside of the follower tube socket has an outer diameter matching the inside diameter of the shell. An antirotation strip along the inside of the shell is provided on which the notch of the flange rides as the lead screw rotates.

A collar assembly comprises upper and lower collar caps fastened together with collar assembly bolts and attached to a cartridge shell to create a hollow unit into which various functional rings can be installed.

The upper collar cap has a tapered face which forms a seat into which a flared top portion of the traffic marker tube descends as the tube is lowered into its retracted position so that the device is sealed from the intrusion of water, silt, and grit. The lower collar cap also has a tapered face which forms a seat into which a tapered upper edge of the follower tube socket ascends when the tube is advanced into its raised position, again sealing the device in a similar manner.

The traffic marker tube is equipped with studs which fit into slots in the follower tube socket and lock the tube into the socket when rotated into place. When the studs are rotated in the opposite direction, the tube is released from the socket and can be removed through the top of the device.

An upper electrical connector is installed within or otherwise attached to the collar assembly. An electrical ring containing a lower electrical connector rests upon and is attached to an outer casing. Electrical power is connected to the lower electrical connector.

Installation of the collar and cartridge shell assembly into the outer casing provides connection between the upper and lower electrical connectors to provide electrical power to the unit. Removal of the collar and cartridge shell disconnects the electrical power supply.

An upper limit switch cuts power to the unit and stops the drive motor when the traffic marker tube is advanced into its full raised position. As the tube is lowered into its retracted position, a lower limit switch is activated to again cut power to the unit and stop the drive motor. Activation of either limit switch is detected to indicate the up-or-down status of the follower tube socket.

A series of protrusions on the traffic marker tube (or similar markings) activates a tube status switch or similar reading device. Activation is detected to give an indication of the presence and status (up or down) of the traffic marker tube. The tube status switch resides within a status reader ring which is installed within the modular collar assembly.

An optional heating unit is placed within a heater ring within the modular collar assembly. The heating unit is connected to the electrical power source through the upper electrical connector.

Slope adjustment is provided by placing compression springs onto the collar assembly bolts within the modular collar assembly. Adjustment of the bolts provides for differential compression of the springs and of the modular collar assembly to produce the desired slope of the upper collar cap to match the surrounding pavement surface. The compression springs provide the necessary adjustable spacers between the collar assembly units and the needed force to provide the necessary firmness required by the modular collar assembly.

A solid or powdered lubrication material and a brush assembly arelplaced around the screw and attached to the follower tube socket. The lubrication material and brush assembly move up and down the screw and lubricate and clean it as the unit is activated. Light units are installed within the follower tube to light the interior of the traffic marker tube which, being made of translucent material, is caused to glow. The source of light is contained within the light units and wired to the source of electric power or are contained within the power source with light conveyed to the light units through fiber optics cables or the like.

A watertight assembly consisting of "O"-ring installation or a sealed bearing assembly is placed around a power shaft from the power source to prevent water from entering.

The speed of raising and lowering the traffic marker tube can be made variable by allowing variation of speed of rotation of the power shaft by providing either or both of the following: (1) a rheostat inserted in the power circuit to vary the level of power supply to the motor, and (2) the capability of varying the gear ratios within the power unit.

Accordingly, it is an object of the present invention to provide an improved pop-up traffic control device in which a retractable marker tube can be deployed above or stored below a roadway surface while the interior of the device is sealed from dirt, water, sand, grit, and other deleterious materials.

Another object of the present invention is to provide a pop-up traffic control device including a traffic marker tube which is readily removable and replaceable.

A further object of the present invention is to provide a pop-up traffic control device including a heater inside to prevent possible malfunctioning due to freezing temperatures.

An additional object of the present invention is to provide a pop-up traffic control device which has a slope-adjustment feature for the cover portion thereof, so that the slope of the cover can be matched to the slope of the surrounding roadway.

Yet another object of the present invention is to provide a pop-up traffic control device in which the traffic marker tube is made of a translucent material and which can be illuminated internally by means of a light source within the device.

Still another object of the present invention is to provide a pop-up traffic control device which has a watertight mechanical coupling between a lead screw used to elevate or retract the marker tube and a rotating shaft used to drive the lead screw.

Another object of the present invention is to provide a pop-up traffic control device including a modular collar with an integral electrical connector as part of the device.

Still another object of the present invention is to provide a pop-up traffic control device in which the speed of elevating or retracting the marker tube can be varied.

A further object of the present invention is to provide a pop-up traffic control device including a lubrication and brush assembly mounted on a tube follower attached to the lead screw and surrounding it, so that the lead screw is cleaned and lubricated in operation.

Finally, it is an object of the present invention to provide a pop-up traffic control device which includes a socket and tube status signal unit to provide an indication of the vertical position of the traffic marker tube with respect to the surface of the roadway.

These and other objects and features of the present invention will be apparent from the following detailed description, taken with reference to the figures of the accompanying drawing.

DETAILED DESCRIPTION OF THE INVENTION

Figure 1:
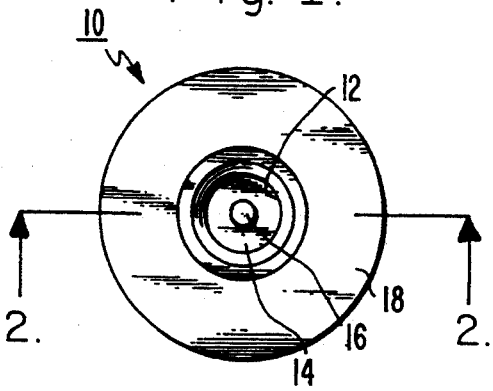
FIG. 1 is a top plan view of the pop-up traffic control device of the invention with the top of the traffic marker tube removed.

Referring to FIG. 1, the pop-up traffic control device of the present invention 10 is shown looking down from above upon the device when the device is mounted in a roadway. Traffic control device 10 comprises a traffic marker tube 12 (with the top 13 removed) mounted on a follower tube socket 14 which has a tapped bore through which a lead screw 16 extends into the interior of traffic marker tube 12.

Traffic marker tube 12 moves up and down with respect to the roadway surface through an opening in a cover 18 which spans an opening in the roadway and comprises part of the housing for traffic control device 10. The material comprising traffic marker tube 12 is preferably a flexible or semirigid plastic so that automobiles accidentally colliding with traffic marker tube 12 will not be damaged. Traffic marker tube 12 is readily removable from device 10 through the opening in cover 18, so that a new marker tube can be installed to replace one that is damaged by automobiles.

Figure 2:
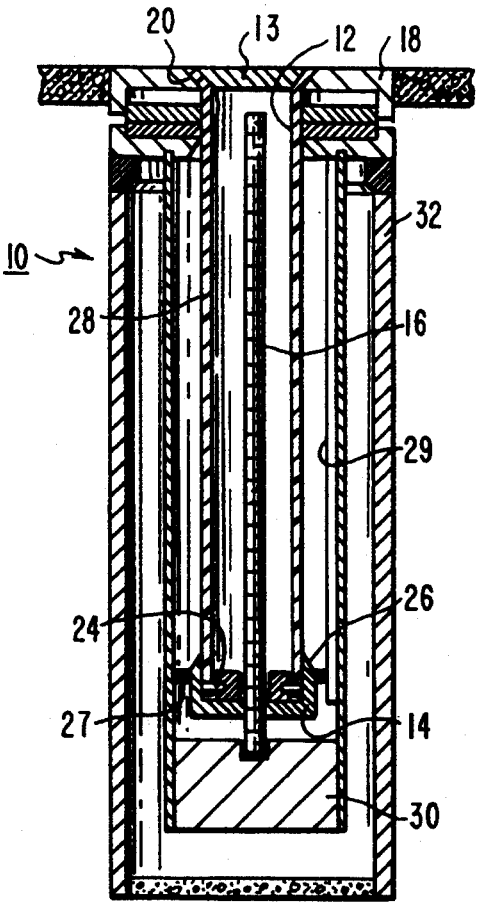
FIG. 2 is a sectional view of the pop-up traffic control device of the invention as indicated in FIG. 1.

Referring to FIG. 2, a sectional view in a plane generally orthogonal to the roadway surface through the center of device 10, traffic marker tube 12 is shown in its lowermost, retracted position beneath the roadway. Traffic marker tube 12 has an elongated form and terminates at its upper end in an outwardly flared portion 20 closed off by top 13. At its lower. end, traffic marker tube 12 is mounted within a follower tube socket 14 by means of studs 24 inside traffic marker tube 12 which fit into corresponding slots inside follower tube socket 14. Follower tube socket 14 has an inwardly sloping shoulder portion 26 at its upper end. An annular flange 27 on socket 14 is adjacent to shoulder portion 26.

Traffic marker tube 12, follower tube socket 14, and lead screw 16 are surrounded by and contained within an elongated shell 28 which is attached at its upper end to cover 18. Flange 27 has a notched-out portion or channel which rides on an antirotation strip 29 along the inside of shell 28 parallel to lead screw 16. This arrangement prevents tube socket 14 from rotating as lead screw 16 rotates. The lower end of shell 28 is closed except for drainage holes 19, and near the bottom end of shell 28 a source of rotational power 30 is mounted. Rotational power source 30 is preferably a reversible dc electric motor. Alternatively, a hydraulic motor could be employed. Rotational source 30 is mechanically coupled to lead screw 16, and when properly activated can cause lead screw 16 to rotate in a clockwise or counterclockwise direction.

Cover 18 is mounted on a tubular outer housing or casing 32 which is set in the opening in the roadway and supports traffic control device 10.

Figure 3:
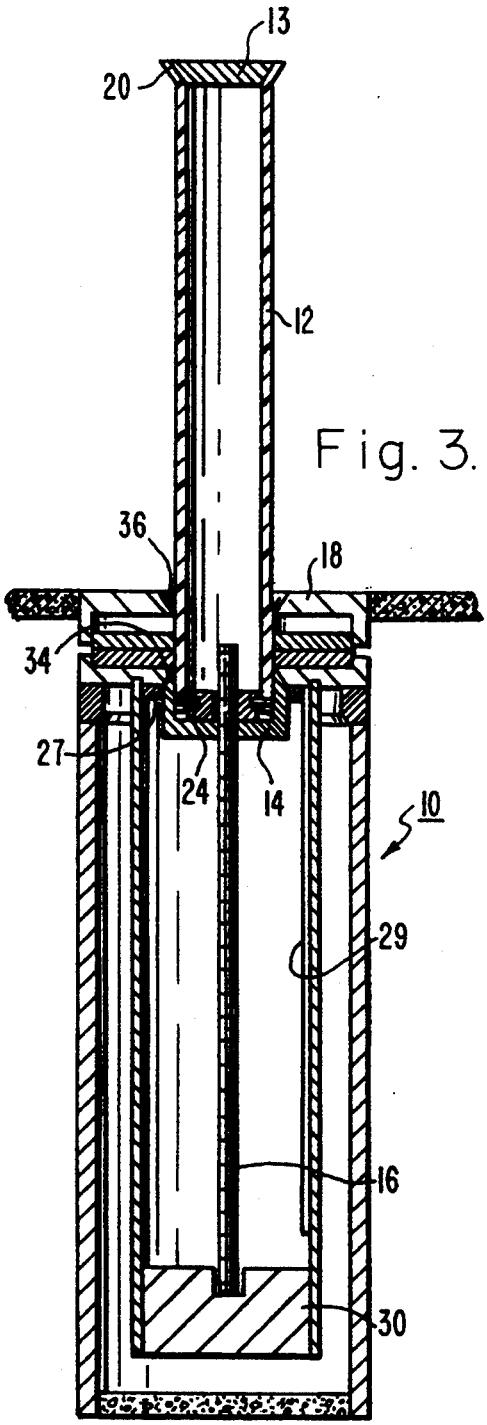
FIG. 3 is a sectional view as in FIG. 2 but with the traffic marker tube elevated in its highest position above the roadway surface.

As shown in FIG. 3, when a rotational power source 30 is activated to rotate lead screw 16 in an appropriate direction, the notched portion of flange 27 rides on antirotation strip 29. Follower tube socket 14 is caused to move upward and traffic marker tube 12 becomes elevated above the roadway. Traffic marker tube 12 is shown in its uppermost elevated position in FIG. 3. The bottom end of cover 18 surrounding the central opening through which traffic marker tube 12 moves has an outwardly sloping shoulder portion 34 to form a space into which shoulder portion 26 of follower tube socket 14 fits to seal the interior of shell 32 from the outside environment.

When rotational power source 30 is activated in such a way that lead screw 16 is caused to rotate in an opposite screw sense, follower tube socket 14 will move downward on antirotation strip 29 and lead screw 16 and marker tube 12 will descend to its retracted position beneath the roadway. In the lowermost position of marker tube 12, outwardly flaring upper end 20 of marker tube 12 abuts a complementarily shaped shoulder portion 36 of the top end of cover 18 to again seal the interior of shell 28 from the outside.

Figure 4:
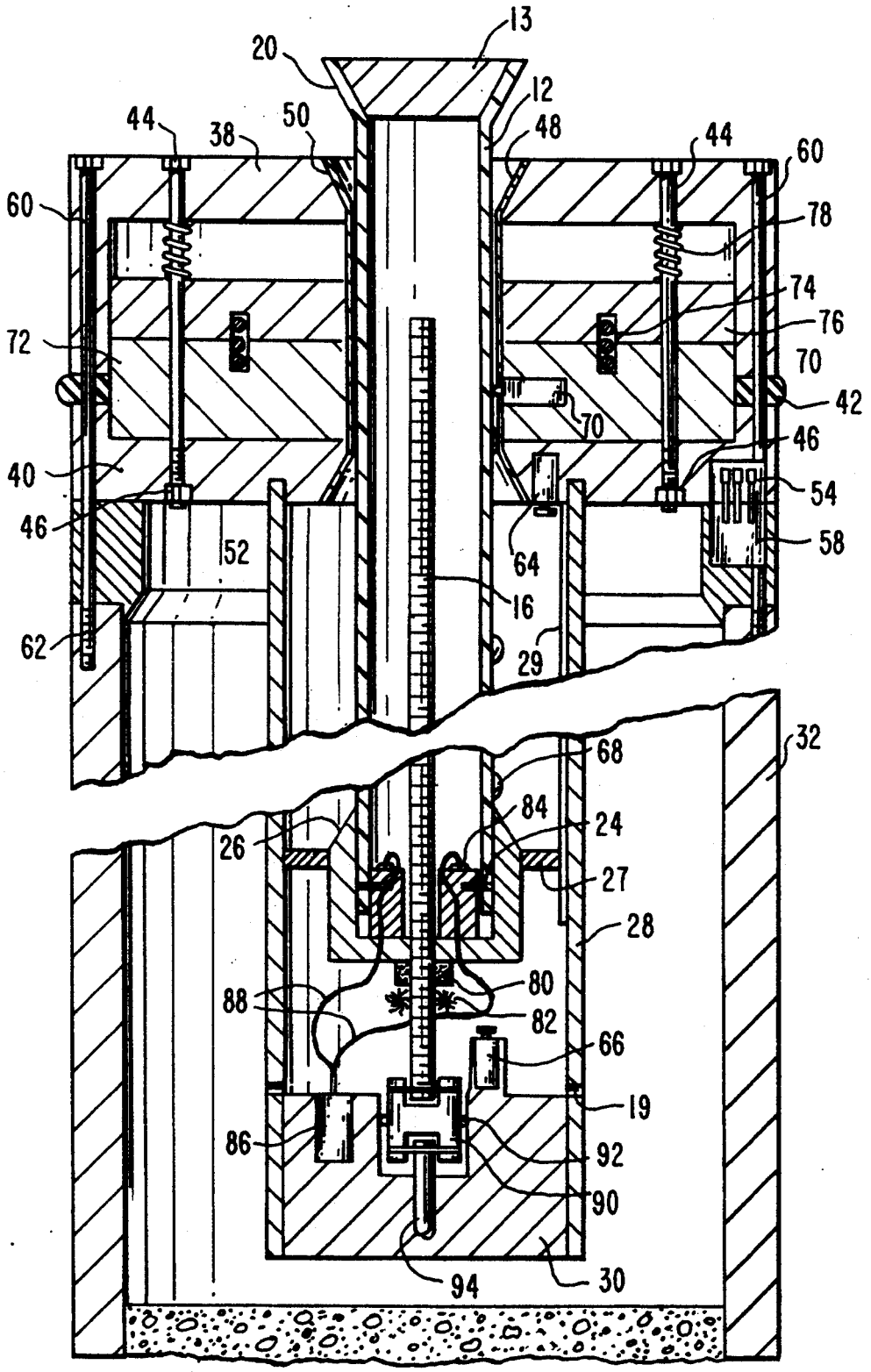
FIG. 4 is a sectional view similar to FIGS. 2 and 3 but showing the traffic marker tube only partly elevated and with the invention shown in greater detail.

Additional details and optional features of traffic control device 10 are depicted in FIG. 4. Cover 18 comprises an upper collar cap 38 and a lower collar cap 40 Which are abuttingly sealed together along a common peripheral portion with a layer 42 of mastic or similar flexible sealing material. Upper collar cap 38 and lower collar cap 40 are fastened together with a plurality of collar assembly bolts 44 which extend through aligned holes and are secured by collar assembly nuts 46.

An interior space is formed between upper and lower collar caps 38 and 40 into which various functional rings can be installed. Shell 28, which houses rotational power source 30 and various other components, is attached at its upper end to lower collar cap 40 surrounding the opening therein in which marker tube 12 resides.

A collar liner 48 of foam rubber or some similar material is installed in the openings in upper and lower collar caps 38 and 40 surrounding marker tube 12. Collar liner 48 further aids in the sealing of traffic control device 10 from the intrusion of water, silt, grit, and other deleterious materials.

Collar liner 48 has outwardly flaring upper and lower portions 50 and 52. When marker tube 12 is in its lowermost retracted position, uppermost flared portion 20 of marker tube 12 rests against and compresses the material of collar liner 48 at its outwardly flaring upper end 50 to seal marker tube 12 against upper shoulder portion 36 of upper collar cap 38. Similarly, when marker tube 12 is in its uppermost elevated position, inwardly sloping shoulder portion 26 of follower tube socket 14 compresses outwardly flaring lower end 52 of collar liner 48 to seal marker tube 12 against lower shoulder portion 34 of lower collar cap 40.

Traffic marker tube 12 is equipped with studs 24 which fit into slots inside follower tube socket 14 to lock marker tube 12 into follower tube socket 14 when rotated into place. Rotated in the opposite direction, marker tube 12 is released from follower tube socket 14 and can be removed through the top opening of device 10.

Upper electrical connector 54 is installed within or otherwise attached to lower collar cap 40. Electrical ring 56 contains lower electrical connector 58 and rests upon and is attached to outer casing 32. An electrical power supply is connected to device 10 through lower electrical connector 58.

The assembly consisting of upper and lower collar caps 38 and 40, shell 28, and electrical ring 56 is installed in outer casing 32 by means of casing bolts 60 which extend through aligned holes in upper and lower collar caps 38 and 40 and electrical ring 58. Casing bolts 60 screw into threaded receiving holes 62 in outer casing 32. Installation of the assembly of collars 38,40 and shell 28 into outer casing 32 makes a connection between upper electrical connector 54 and lower electrical connector 58, thus providing electrical power to device 10. Removal of the collar and shell assembly disconnects device 10 from the electrical power supply.

Still referring to FIG. 4, as follower tube socket 14 and traffic marker tube 12 are advanced into raised position, an upper limit switch 64 is opened, thereby cutting power to rotational power means 30. Similarly, as follower tube socket 14 and traffic marker tube 12 are lowered into their retracted position, a lower limit switch 66 is opened, thereby cutting power to rotational power means 30. The activation of either limit switch can be detected to indicate the status (up or down position) of follower tube socket 14.

Traffic marker tube 12 is equipped with a series of aligned protrusions 68 along its length which, as traffic marker tube 12 is raised or lowered, activate tube status switch 70 or a similar reading device. Activation of switch 70 is detected to give indication of presence and status (up or down position) of traffic marker tube 12. Tube status switch 70 or some similar reading device is placed within status reader ring 72 which is installed within the interior space between upper and lower collar caps 38 and 40.

A heating unit 74 is placed within a heater ring 76 which is installed within the interior space between upper and lower collar caps 38 and 40. Heating unit 74 is connected to an electrical power source through upper electrical connector 54. The provision of heating unit 74 can be optional depending on the climate in which traffic control device 10 is employed.

Compression springs 78 are placed onto collar assembly bolts 44 within the modular collar assembly. Adjustment of bolts 44 and nuts 46 provides for differential compression of springs 78 to vary the orientation of upper collar cap 38 with respect to lower collar cap 40. In this way a desired slope of upper collar cap 38 can be produced to match the surrounding pavement surface. Compression springs 78 provide the necessary adjustable spacers between upper collar cap 38 and the "uppermost top of whatever functional rings are installed in the modular collar assembly. Springs 78 also provide the necessary firmness to the collar assembly.

A solid or powdered lubrication material 80 and a brush assembly 82 are placed around lead screw 16 and are attached to follower tube socket 14 to lubricate and clean screw 16 as device 10 is activated and follower tube socket 14 moves up and down on screw 16.

Lighting units 84 are installed within follower tube socket 14 to light the interior of traffic marker tube 12. Preferably traffic marker tube 12 comprises at least in part a translucent material which will transmit light from lighting units 84. The translucent portions of traffic marker tube 12 can be caused to glow by a light source contained within lighting units 84 and wired to a source of electrical power. Alternatively, a light source 86 could be provided with light conveyed to lighting units 84 through fiber optic cables 88. The provision of lighting units 84 can be an optional feature of traffic control device 10.

A watertight assembly 90 comprises an "O"-ring installation 92 or sealed bearing assembly placed around power shaft 94 from rotational power source 30. Assembly 90 prevents water from entering rotational power source 30.

The speed at which traffic marker tube 12 is raised or lowered can be varied by varying the speed of rotation of power shaft 94. This can be accomplished by providing either or both of the following: (1) a rheostat unit inserted in the power circuit to vary the level of electrical power supplied to rotational power source 30; (2) the capability of varying gear ratios within rotational power source 30.

While specific embodiments of the invention have been described and illustrated, it should be understood that these embodiments are provided by way of example only, and that the invention is not to be construed as being limited thereto, but only by the proper scope of the following claims.

I claim:

1. A traffic control device mounted below a roadway and flush with the surface thereof comprising:

a substantially cylindrical, open-bottomed housing mounted in said roadway;

an elongated marker means for providing a barrier extensibly mounted in said housing;

movement means for extending said marker means to a first position above said roadway surface and retracting said marker means into a second position in said housing;

remote control means operatively related to said movement means, for activating said movement means to extend or retract said marker means; and wherein said marker means has a bottom end with a tapped hole therethrough adapted to receive a threaded shaft forming part of said movement means and wherein said marker means is nonrotatably mounted in said housing so that rotation of said threaded shaft in one screw sense or the other causes said marker means to move out of or into said housing and wherein said marker means is sealingly mounted in relation to said housing and is releasably removable from said housing when the marker means is in said first positions. whereby the marker means is easily replaceable without having to disassemble and/or replace the device.

2. The traffic control device of claim 1 wherein said marker means is a hollow tube closed at a top end.

3. The traffic control device of claim 1 wherein said marker means comprises a hollow tube closed at a top end thereof and wherein said bottom end of said marker means is open, and wherein said movement means further comprises a follower tube socket adapted to releasably hold said bottom end of said marker means by use of a fastening means for fixedly attaching said marker means to said follower tube socket, and said fastening means accessible when said marker means is in said first position mounted on a threaded shaft, so that rotation of said shaft in one screw sense or the other causes said marker means to move out of or into said housing.

4. The traffic control device of claim 3 further comprising means for lubricating and cleaning said threaded shaft attached to said follower tube socket and disposed around said shaft at a lower end of said socket and said fastening means comprising at least one slot on said follower tube socket for association with at least one stud located at said bottom end of said hollow tube.

5. The traffic control device of claim 1 wherein said marker means is made of a translucent material and said device further comprises light producing means for directing light into said hollow tube so that said tube appears to glow when said light producing means is activated.

6. The traffic control device of claim 1 wherein said upper end of said marker means has a frustoconical, outwardly flaring shape adapted to sealingly abut a complementarily shaped surface at a top end of said housing when said marker is in said second position.

7. The traffic control device of claim 6 wherein said housing comprises a housing cover flush with said surface of said roadway, having a bore therethrough in which said marker means is adapted to move up and down, said bore being lined with a liner having a generally cylindrical midportion, a first outwardly flaring end, and a second outwardly flaring end, said liner comprising a material adapted to seal said upper end of said marker member against said cover in said first position and seal an upper end of said follower tube socket against said cover in said second position.

8. The traffic control device of claim 7 wherein said cover comprises an upper collar cap and a lower collar cap joined along an interior peripheral portion thereof by a layer of deformable adhesive material, and having a hollow annular interior space surrounding said liner.

9. The traffic control device of claim 8 further comprising heating means disposed in said hollow annular interior space between said upper and lower collar caps, for producing heat, wherein said heating means is remotely controllable.

10. The traffic control device of claim 8 further comprising slope-adjusting means joining said upper and lower collar caps, for adjusting the orientation of said upper collar cap with respect to said lower collar cap, whereby the orientation of said upper collar cap can be matched to the slope of the surrounding roadway surface.

11. The traffic control device of claim 10 wherein said slope-adjusting means comprises a plurality of spring-loaded bolts, each bolt passing through a pair of aligned through holes in said upper and lower collar caps and each secured by a nut at a lower threaded end of said bolt.

12. The traffic control device of claim 1 further comprising a source of rotational power inside said housing and means for watertight connection between said threaded shaft and said source of rotational power.

13. The traffic control device of claim 12 further comprising first and second limit switch means for switching off electrical power to said source of rotational power when said first or second position, respectively, of said marker means has been achieved through rotation of said threaded shaft.

14. A traffic control device mounted below a roadway and flush with the surface thereof comprising:

a tubular base mounted generally vertically in a hole below said roadway surface; cover means for covering said hole in said roadway, having a bore therethrough with frustoconical, outwardly sloping upper and lower ends, said cover means being mounted to said base;

an elongated shell closed at a bottom end thereof except for a plurality of drainage holes and attached at an upper end thereof to a lower end of said cover means, so as to surround said bore in said cover means and provide an interior compartment communicating with said bore in said cover means;

an elongated marker tube disposed in said bore of said cover means and free to move down and up therein between first and second limiting positions, respectively, said marker tube having a closed, outwardly flaring upper end and an open lower end;

a tube follower releasably attached to said lower end of said marker tube by way of a fasteninq means and accessable thereto when said marker tube is said first position, said tube follower having a tapped bore therein and an inwardly tapered upper end; and a threaded shaft disposed in said tapped bore of said tube follower, having a free upper end and a lower end connected to a source of rotational power within said shell.

15. The traffic control device of claim 14, further comprising a liner tube surrounding said marker tube, having an upper frustoconical outwardly flaring end and a lower, outwardly flaring frustoconical end, said liner tube comprising a material adapted to seal said marker tube against said cover when said marker tube is in said first position, and to seal said marker tube against said tube follower when said marker tube is in said second position.

16. The traffic control device of claim 15 wherein said cover means comprises an upper collar cap and a lower collar cap joined along interior peripheral portions thereof by a layer of deformable adhesive material, and having a hollow annular interior space surrounding said liner tube.

17. The traffic control device of claim 16 further comprising heating means disposed in said hollow annular interior space between said upper and lower collar caps, for producing heat, wherein said heating means is remotely controllable.

18. The traffic control device of claim 16 further comprising slope-adjusting means joining said upper and lower collar caps, for adjusting the orientation of said upper collar cap with respect to said lower collar cap, whereby the orientation of said upper collar cap can be matched to the slope of the surrounding roadway surface.

19. The traffic control device of claim 18 wherein said slope-adjusting means comprises a plurality of spring-loaded bolts, each bolt passing through a pair of aligned through holes in said upper and lower collar caps and each secured by a nut at a lower threaded end of each said bolt.

20. The traffic control device of claim 14 further comprising means for lubricating and cleaning said threaded shaft, attached to said follower tube socket and disposed around said shaft at a lower end of said tube socket.

21. The traffic control device of claim 14 further comprising means for watertight connection between said threaded shaft and said source of rotational power and said fastening means comprising at least one slot defined by said follower tube socket for association with at least one stud located at said bottom end of said hollow tube, whereby said stud fits into said slot and locks said follower tube socket when rotated in place and when said stud is rotated in the opposite direction, said tube is released from said socket and can be removed.

22. The traffic control device of claim 14 further comprising first and second limit switch means for switching off power to said source of rotational power when said first or second position, respectively, of said marker member has been achieved through rotation of said threaded shaft.

23. The traffic control device of claim 22 further comprising means for sensing the activation of said first or second limit switch means and indicating whether said marker tube is in said first or second position.

24. The traffic control device of claim 14 further comprising means for varying the speed of rotation of said threaded shaft, mounted inside said shell.

25. The traffic control device of claim 14 wherein said traffic marker tube further comprises a series of spaced and vertically aligned protuberances on an outer surface of said traffic marker tube, and wherein a means for sequentially sensing said protuberances and producing sequential signals in response thereto is mounted adjacent to said traffic marker tube, whereby the vertical position of said traffic marker tube can be determined by counting said sequential signals from said sensing means.

26. The traffic control device of claim 14 further comprising light-producing means mounted inside said shell, for directing light into said marker tube, and wherein said marker tube comprises a translucent material so that said tube appears to glow when said light producing means is activated.

* * * * *